US005497609A

United States Patent [19]

Lawrence et al.

[11] Patent Number: 5,497,609

[45] Date of Patent: Mar. 12, 1996

[54] SPINNING OF YARN

[75] Inventors: Carl A. Lawrence, Hebden Bridge, England; Rong K. Jiang, Shanghai, China

[73] Assignee: British Technology Group Ltd., London, England

[21] Appl. No.: 442,293

[22] Filed: May 16, 1995

Related U.S. Application Data

[63] Continuation of Ser. No. 220,578, Mar. 31, 1994, abandoned, which is a continuation of Ser. No. 101,106, Aug. 3, 1993, abandoned, which is a continuation of Ser. No. 914,018, Jul. 15, 1992, abandoned, which is a continuation of Ser. No. 689,789, May 20, 1991, abandoned.

[30] Foreign Application Priority Data

Nov. 23, 1988 [GB] United Kingdom ..... 8827367

[51] Int. Cl.[6] ..... D01H 4/18; D01H 4/38

[52] U.S. Cl. ..... 57/400; 57/401; 57/411

[58] Field of Search ..... 57/400, 401, 408, 57/411

[56] References Cited

U.S. PATENT DOCUMENTS

| | | | |
|---|---|---|---|
| 3,855,772 | 12/1974 | Burlet | 57/400 |
| 3,901,012 | 8/1975 | Safar . | |
| 3,981,137 | 9/1976 | Fehrer . | |
| 4,497,168 | 2/1985 | Kamp | 57/401 |
| 4,537,021 | 8/1985 | Parker | 57/411 X |
| 4,545,194 | 10/1985 | Juillard . | |
| 4,640,089 | 2/1987 | Stalder et al. | 57/401 |
| 4,679,388 | 7/1987 | Artzt et al. | 57/401 X |
| 4,704,853 | 11/1987 | Lowrence | 57/401 |
| 4,744,210 | 5/1988 | Raasch et al. | 57/401 |

FOREIGN PATENT DOCUMENTS

| | | | |
|---|---|---|---|
| 208274 | 7/1986 | European Pat. Off. . | |
| 2545108 | 11/1984 | France . | |
| 3135363 | 3/1983 | Germany | 57/400 |
| 3318924 | 11/1984 | Germany . | |
| 3402368 | 8/1985 | Germany | 57/401 |
| 1456414 | 11/1976 | United Kingdom . | |
| 1458496 | 12/1976 | United Kingdom . | |
| 2054671 | 2/1981 | United Kingdom . | |
| 2122226 | 1/1984 | United Kingdom . | |
| 2145746 | 4/1985 | United Kingdom . | |

OTHER PUBLICATIONS

Lawrence and Chen, "Fibre Dynamics in Open End Spinning", Melliand Tectilberichte, Feb. 1986, pp. 85–93, and English translation thereof.

*Primary Examiner*—Joseph J. Hail, III

*Attorney, Agent, or Firm*—Cushman, Darby & Cushman

[57] ABSTRACT

A method and apparatus for spinning fibres into yarn including providing a supply of fibres, providing a yarn-building region, opening fibres from the supply into the region, landing opened fibres in said region, removing energy from landing fibres, building and twisting the fibres landed in the region into a yarn and withdrawing the yarn from the region. The fibres may be landed leading-end first in said region. The fibre trailing-end may be flicked to remove energy from the landing fibre.

22 Claims, 5 Drawing Sheets

SPINNING OF YARN

Figure 1:
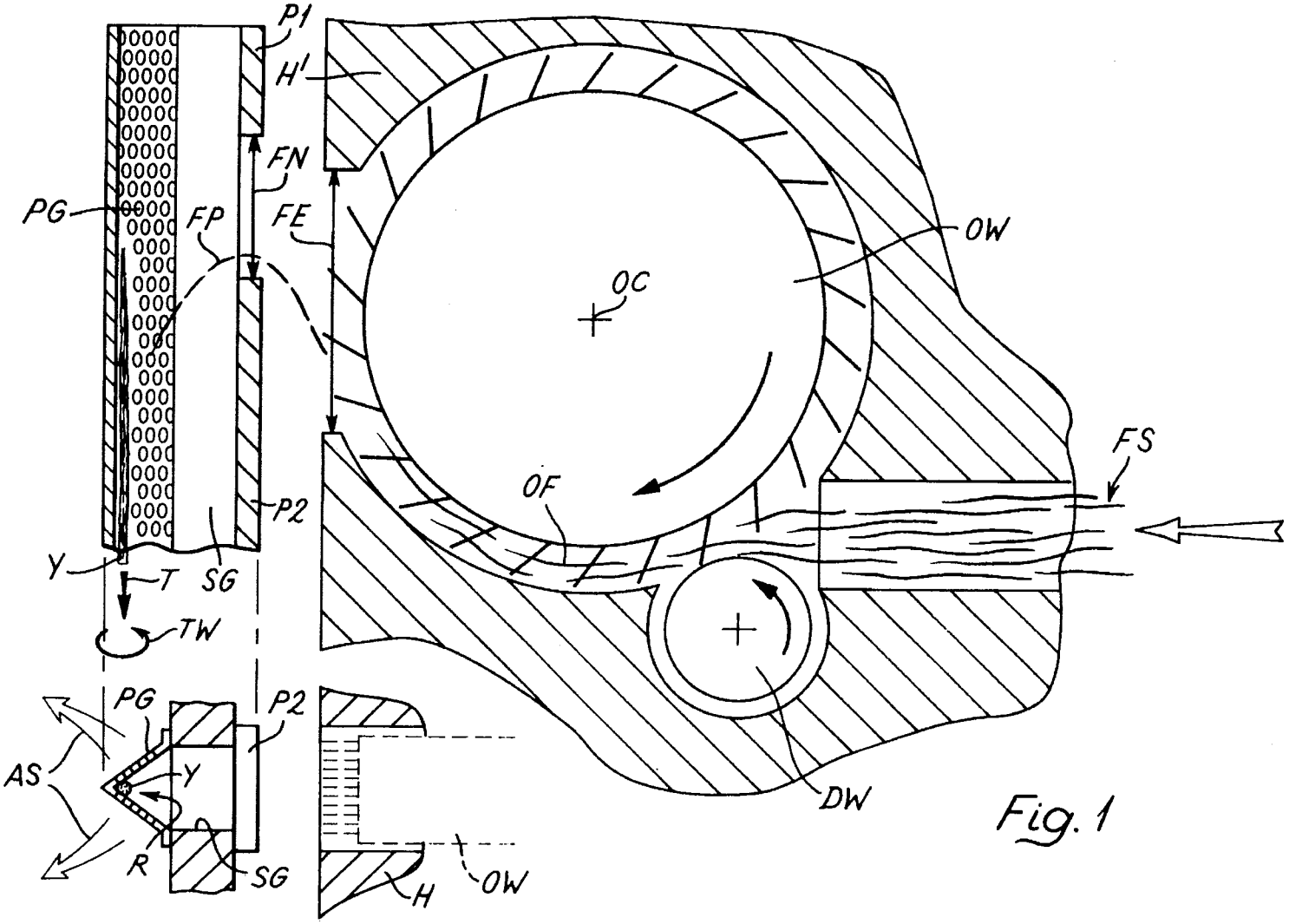

This is a continuation of application Ser. No. 08/220,578, filed on Mar. 31, 1994, which was abandoned upon the filing hereof, which is a continuation of Ser. No. 08/101,106 filed Aug. 3, 1993, now abandoned; which is a continuation of Ser. No. 07/914,018 filed Jul. 15, 1992, now abandoned which is a continuation of Ser. No. 07/689,789 filed May 20, 1991, now abandoned.

This invention relates to spinning, that is forming fibres into a yarn.

The traditional, and fundamental, actions of spinning are the provision of a band or sliver of fibres, the arranging of fibres from the band into a yarn of required size and the insertion of twist to stop the yarn from reverting to individual fibres.

Many techniques have been proposed to make spinning more efficient and these generally have both advantages and disadvantages which lead to a particular technique being preferred for a particular type of yarn or speed of production or degree of automation or other factor which is significant to the potential user.

Hitherto spinning techniques have used air flow, e.g. suction, in a duct or mechanical or electrostatic devices to carry separated fibres from a band or sliver over a long distance, particularly when compared with fibre length, and present them for arrangement into a yarn. Examples are UKPS 2097827 which uses air suction in a duct, U.S. Pat. No. 4,640,089 which uses a duct In which fibres freely float and has a convergent outlet, U.S. Pat. No. 3,855,772 which uses a circular conveyor, and UKPS 1456414 which uses electrostatic force. These examples are typical of many old and more recent techniques by which fibres are carried for spinning.

Recent studies, particularly with very high speed cinematography, have begun to give some knowledge of the behaviour of fibres being carried from sliver to yarn. Reference is directed to Meilland Textilberichte (2/1986) pages 85 to 93 Die Faserdynamick in der OE-Spinnerei (C. A. Lawrence, K. Z. Chem) and U.S. Pat. No. 4,704,853 (inventor C. A. Lawrence).

It is an object of the invention to provide a spinning technique using improved fibre control.

According to the invention there is provided a method of spinning fibres into yarn including:

providing a supply of fibres, providing a yarn-building region, opening fibres from the supply into the region, landing opened fibres in said region, removing energy from landing fibres, building and twisting the fibres landed in the region into a yarn and withdrawing the yarn from the region.

Desirably the fibre trailing-end is flicked to remove energy, this flicking of the fibre trailing-end being vigorous to straighten the landing fibre to its full length.

Advantageously fibres are landed leading-end first after moving along a definite path from said opening means to said region.

Conveniently the pressure in the yarn-building region is reduced, drawing fibres opened from the supply into the region.

Preferably the pressure in the yarn-building region is not uniform, so as to increase the control of the motion of the fibres and to encourage the fibre leading-end to approach the yarn-end.

According to the invention there is also provided a yarn spinning apparatus including means to open fibres from a supply of fibres, a yarn-building region to receive fibres opened from the supply and means to transfer fibres from the opening means to the yarn-building region, in which apparatus the transfer means includes fibre motion-energy control means of first and second fibre transfer apertures of the opening means and the yarn-building region respectively with the second aperture spaced from and restricting the first, through which apertures leading ends of fibres being opened land and by which trailing ends of fibres have energy extracted therefrom.

Advantageously said second aperture forms a weir.

Desirably the means to flick the fibre trailing-end straightens out the landing fibre to its full length.

Conveniently the yarn-building region includes a fibre landing groove and a fibre entry over the groove and there are means to reduce the pressure in said groove and means to withdraw built yarn from the groove, the arrangement being such that a fibre leading-end entering the region for landing has the trailing-end flicked on passing through the entry.

In one apparatus the groove has perforations for the withdrawal of air by the pressure reduction means. When the opening means is an opening wheel the yarn landing groove is spaced from the wheel and generally parallel to a tangent to the wheel at the fibre exit. The fibre entry to the yarn-building region overlaps the fibre exit of the opening means to achieve the arrangement to flick the fibre trailing-end. There may be a non-uniform pressure in the region, preferably caused by the arrangement of the fibre entry, controlling the motion of the fibres to encourage the fibre leading-end to approach the yarn-end.

The yarn-building region may include a groove formed by the cylindrical surfaces of two side-by-side drums and the fibres may be brought to the region by the rotation of a drum, the fibre being landed in said region along the cylindrical surface of said drum.

Figure 2A:
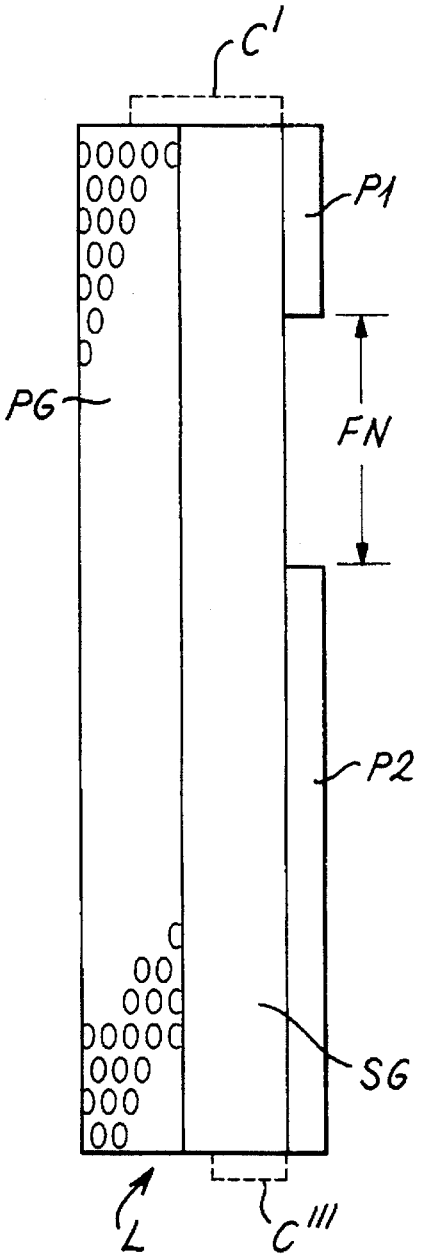
Figure 2B:
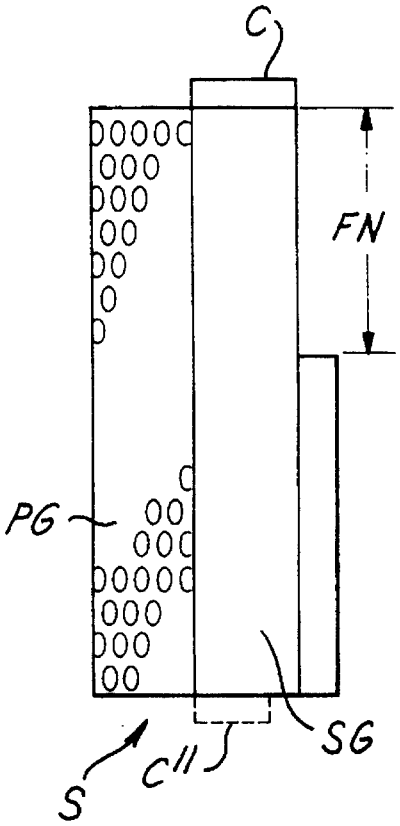
Figure 3A:
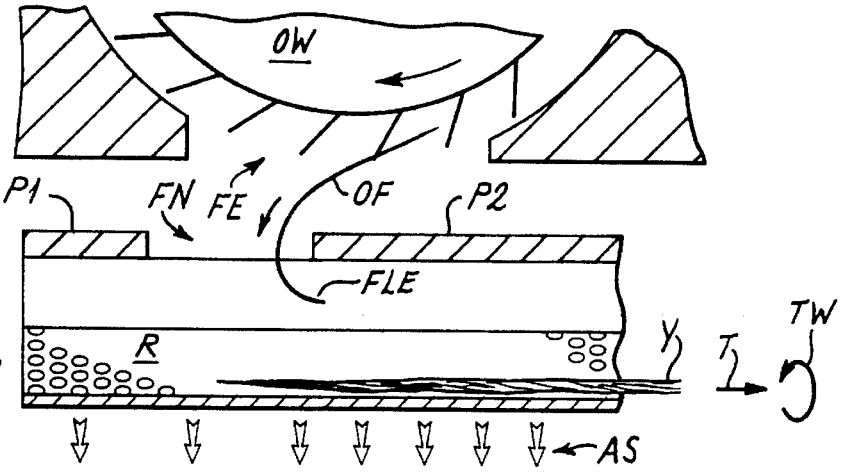
Figure 3B:
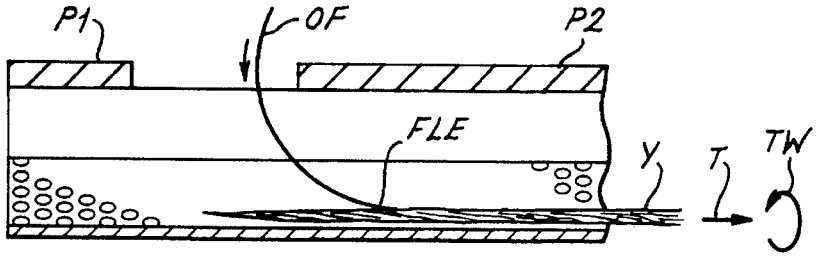
Figure 3C:
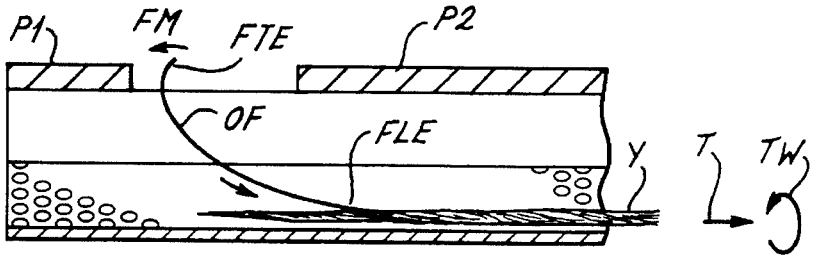
Figure 3D:
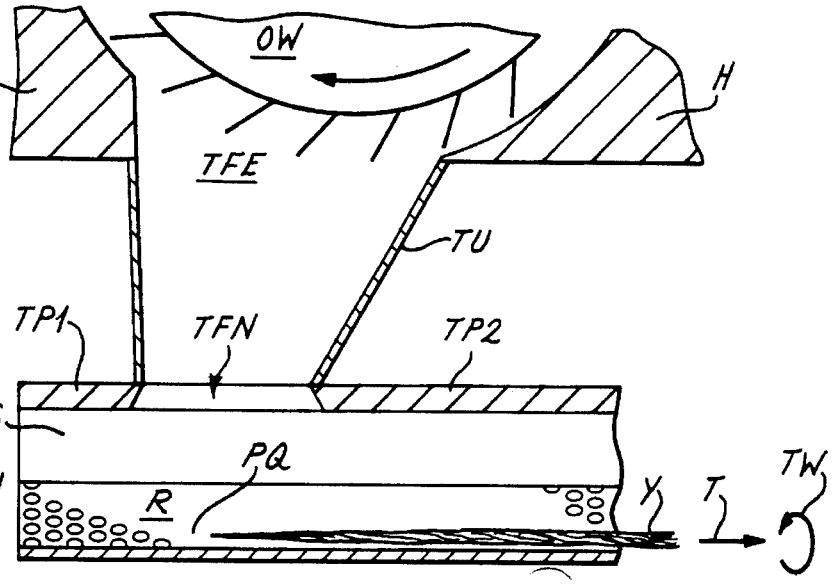
Figure 4A:
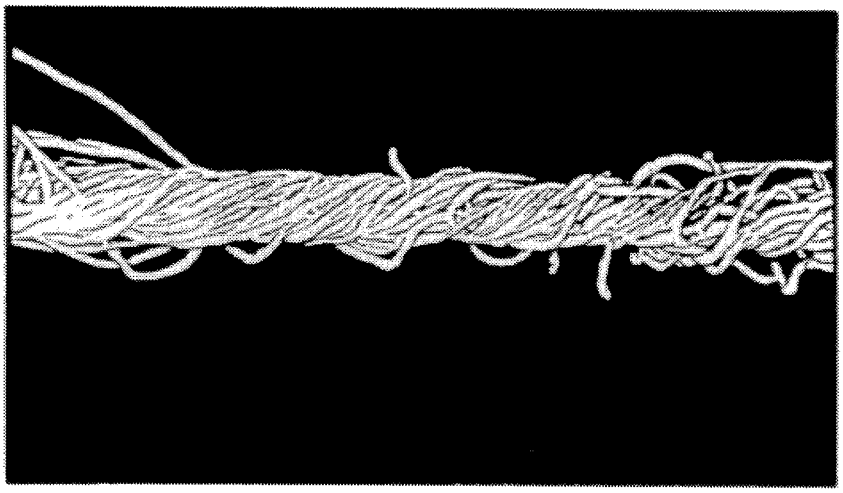
Figure 4B:
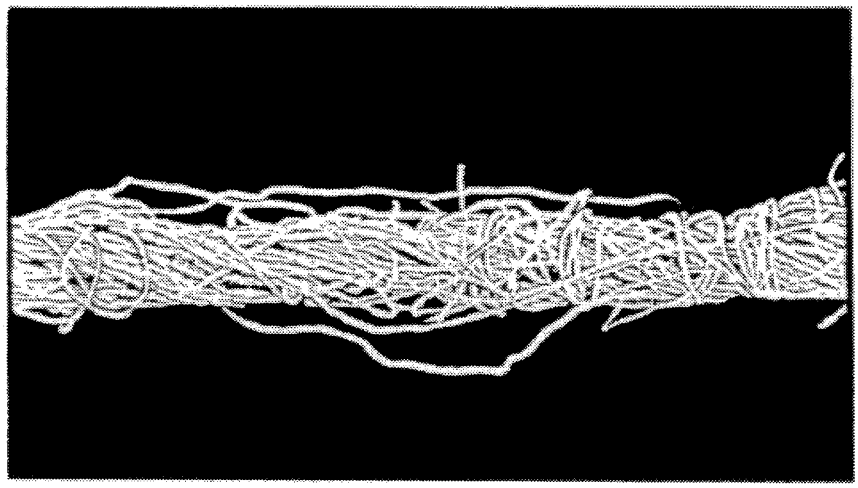
Figure 4C:
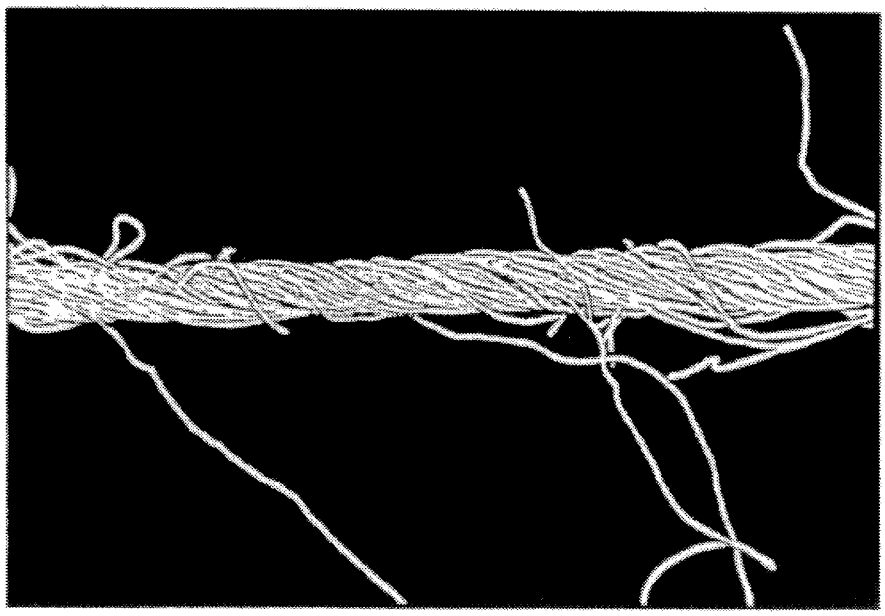
Figure 5A:
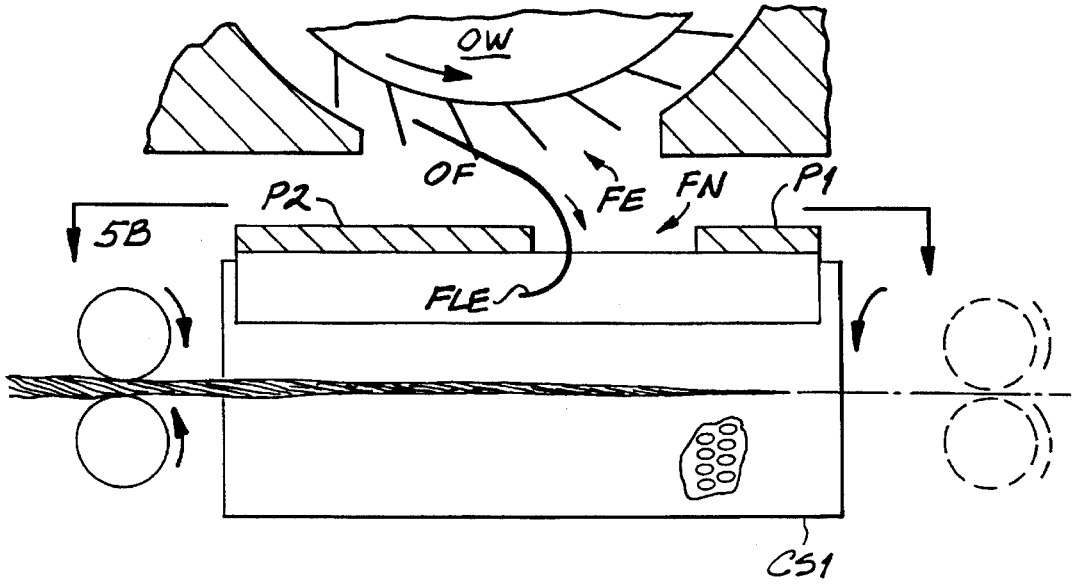
Figure 5B:
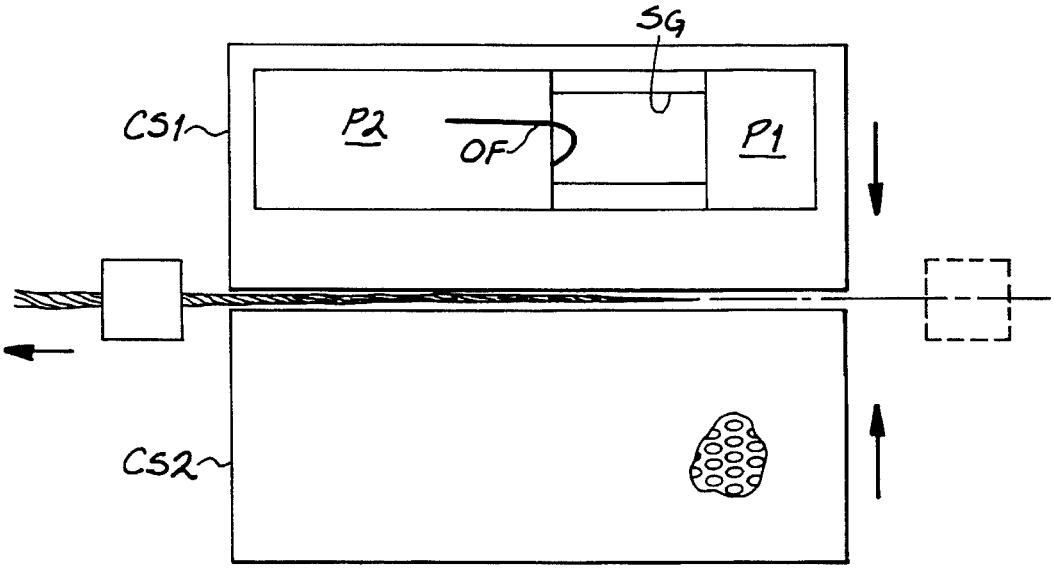

Embodiments of the invention will now be described with reference to the accompanying drawings in which:

FIG. 1 is a part-sectional schematic view of a spinning apparatus according to the invention showing an opening wheel and yarn-building region, FIGS. 2*a* and 2*b* show various yarn-building regions, FIGS. 3*a* through 3*d* show an approximate generalised motion of a fibre in an apparatus such as is shown in FIG. 1 and in FIG. 3*d* an outline of fibre motion in another apparatus according to the invention, FIGS. 4*a* through 4*c* show photographs of yarn, FIG. 5 shows at FIGS. 5*a* and 5*b*, another arrangement of the yarn building region of the present invention.

FIG. 1 shows an opening means (of conventional form) by which fibres from a fibre sliver FS are driven by driving wheel DW to be opened by an opening wheel OW in housing H. Opened fibres OF are ejected from the wheel through a fibre exit FE. The invention provides adjacent the fibre exit FE a fibre entry FN to a yarn-building region R. The entry FN is spaced from and overlaps fibre exit FE in a relation to be discussed below. In one embodiment of the invention the entry FN is defined by two opposed plates P1, P2 which can be regarded as forming a weir for the flow of fibres. In such an embodiment the yarn-building region R is shaped generally as a porous or perforated V-groove with the top of the groove partly covered lengthwise by the plates P1, P2. In FIG. 1 the main drawing shows a lengthwise section of the groove of region R and the linked detail drawing shows a transverse section across the groove in the region of the fibre entry FN. The ends of the groove are not shown but are generally partly closed, apart from a yarn passage, as discussed below.

The perforated or porous yarn-building region R is conveniently supported by a solid groove part SG nearer the fibre entry FN. A perforated groove part PG is further from the entry and gives the V-form of the groove. To enable air to be extracted from the region R suction AS may be applied to draw air through the perforations of groove part PG. An enclosure, not shown, may be needed for efficient air extraction. In some arrangements it may be useful to have a non-uniform air pressure in groove parts SG and/or PG. In certain arrangements the fibre exit FE and fibre entry FN can be linked by a tube, such as is discussed below with reference to FIG. 3*d*.

It is important to note that tile invention provides continuous control of fibre movement in distinction from prior arrangements in which fibres are deliberately caused to float in air-streams.

In operation of the arrangement a yarn Y is built in region R and withdrawn and twisted as indicated by arrows T and TW. Conventional means may be used to produce the actions indicated by the arrows, including belt-twisters. In this operation opened fibres are caused to travel along a path generally indicated for the fibre leading end at FP.

The operation of the arrangement is as follows. Opened fibres OF leave through fibre exit FE and move toward region R through fibre entry FN. In this embodiment the pressure reduction in region R is greater below plate P2 and assists this movement and controls the motion of the fibre. The leading-end of the opened fibre follows the general path FP as the leading end lands on the end of yarn Y being built in and drawn from perforated groove part PG. As the leading-end is built into the twisting and moving yarn-end the trailing end of the opened fibre is drawn along path FP but "flicked" away to move the trailing-end to straighten the fibre to its full length as it is drawn into the yarn being built. It is believed desirable that a "whip-lash" action be produced at the trailing-end.

To start the spinning process a yarn is held in the yarn-building region and drawn through and twisted to cause fibres to build on as described above.

The velocity with which the yarn moves should not be more than that of the fibre landing on it. The term velocity, which is associated with direction, is used to emphasise that it is the velocity of the fibre leading-end in the direction of the yarn movement which matters. The direction of fibre movement is changed rapidly as it is carried by the air-flow to achieve the "flick" of the trailing-end. This procedure removes energy from the fibres and thus slows them down as they are built-in to the yarn, reducing the risk of wrapping the fibre around the yarn at one point. This can be the result of too high a fibre velocity perpendicular to the yarn.

FIG. 3 shows the believed motion of the fibre.

FIG. 3*a* shows how the leading-end FLE of an opened fibre OF having entered region R through entry FN is first brought towards the end of a yarn Y. In particular the more numerous arrows of the air suction AS beneath plate P2 indicate the greater suction here which controls the fibre motion to curve the leading FLE under plate P2 while moving towards the yarn-end. In FIG. 3*b* the leading end is built into the yarn and drawn along with the yarn while the opened fibre continues to move through entry FN, the trailing part beginning to move towards plate P1. As shown in FIG. 3*c* the final stage of the building-in of the fibre is to "flick" the fibre trailing-end FTE with a motion FM out of the initial path, straightening the fibre to its full-length as it is laid along the V-groove and built-in to the yarn which continues to twist as it moves from region R.

The dimensions for the arrangement have been found to be related to fibre length, any pressure reduction in region R, the fibre opening action and the nature of the fibre. However some general indication can be given. For fibres of cotton some 30 to 40 millimeters and specifically 36 mm long the opening wheel is about 60 millimeters in diameter and operates at about 6000 rpm. The fibre exit FE, between H and H', is preferably greater than the length of the fibres to be spun. The groove part PG can be some 10 millimeters wide by 7 millimeters deep. The groove part SG is also some 10 millimeters wide and 7 millimeters deep. The length of the groove can be about 100 millimeters, with entry FN as shown, down to some 50 millimeters with other arrangements of entry FN. The perforations should be some 20% to 50% of the surface part PG with holes 1 millimeter to 1.5 millimeters in diameter on any convenient spacing and layout. Some or all of the perforations may be elongate in the yarn direction. This can help yarn formation by exerting extra tension on fibre trailing-ends while leading-ends are being twisted into the yarn. For porous material similar requirements on percentage apply. The plates P1, P2 are about 2 millimeters thick. The gap between the plates P1, P2 and the housing H is some 5 millimeters for the fibres mentioned above. The overlap of the exit FE and entry FN is arranged to give a clear opening (P2 to H' in FIG. 1) of about 10 millimeters. In view of the groove width of some 10 millimeters the clear opening is about 10 millimeters square. The point OC represents the axis of the opening wheel OW and the position of OC can be significant. If OC is too high and thus H' too near the level of the edge of plate P1 the fibres are not properly built onto the yarn-end and can pile up in the upper end of the groove. In the arrangement for 36 millimeter cotton fibres the level of OC is some 1 to 3 millimeters below the edge of plate P2. The reduction of air pressure In region R is some 50 to 100 millimeters of mercury (say 0.06 to 0.12 bar) with the reduction being larger as the speed of operation increases. The reduction is preferably non-uniform as mentioned above. The relevance of the various dimensions are believed to be as follows. If the reduction in pressure is not enough the yarn is poorly compacted. The level of the edge of plate P2 with respect to the housing H' (the same 10 millimeter dimension mentioned above) has a considerable effect on yarn quality. The spacing is also significant.

As shown In FIG. 2 a longer groove, FIG. 2*a*, has plates P1, P2 on either side of the fibre entry FN while a shorter groove, FIG. 2*b*, has only one plate, P2, the groove being open right to one end with a closure C on the end face of the solid groove part SG, this closure being essential for proper yarn production. Both ends of the longer groove L and the end of shorter groove near plate P2 may be at least partly closed, exemplified by broken line parts C', C", C'" to reduce air flow and the load on the means to reduce pressure in region R.

For the exemplary opening wheel speed of 6000 rpm and 30 to 40 millimeter fibres the yarn is withdrawn at speeds preferably in the range 40 meters per minute up to 200 meters per minute and twisted by, for example, belts with a surface speed four to five times greater than the yarn withdrawal speed.

The effect of the spinning action in the apparatus can be examined by stopping yarn withdrawal and allowing just a few fibres to build up in the groove as a bundle. When the bundle is carefully removed and examined the fibres are found to be compacted together at the leading-ends, as for a yarn, while the more easily separated trailing-ends show a slight "drafting", i.e. a straightening and aligning. If the upper end (in FIG. 1) of the groove is completely closed for this examination the trailing ends of the fibres tend to be curled back on themselves, supporting the view that the "flicking", and consequent whiplash action, are beneficial as this effect is reduced by the closure of the end in this arrangement.

FIG. 3*d* shows an arrangement in which the fibre exit TFE is linked to the fibre entry TFN by a tube TU of special form. References similar to those used above identify similar elements. The plates TP1 and TP2 are chamfered on the side towards yarn-building region R while the tube TU tapers as it approaches the fibre entry TFN. The tube and plates together form a fibre channel which has a waist between tapering parts. Particularly with longer fibres, say 75 millimeters and upwards, this arrangement is believed to assist in avoiding the fibres having a "concertina" form when they land on the yarn. This is achieved by initially speeding up the leading part and then slowing down the trailing part, also by causing the "whip lash" or flick of the trailing end in its landing phase.

Those skilled in the art will appreciate how normal ancilliary arrangemets such as trash removal can be applied.

FIG. 4 shows photographs of three yarn structures. FIG. 4*c* is typical of ring-spun yarn, which type of yarn is widely regarded in the industry as an acceptable standard of structure. FIG. 4*b* is typical of rotor spun yarn which is also widely regarded as an acceptable standard. FIG. 4*a* shows a yarn produced in accordance with the present invention which yarn is characterised by a relatively tightly twisted structure without many loosely attached or wrapped around fibres and a relatively regular yarn diameter. The yarn may be a little tightly twisted but is judged to be of near-acceptable standard, even as now produced on a prototype machine. Fancy yarns can of course be produced by adding suitble fibres.

In another arrangement,

FIGS. 5*a* (elevation) and 5*b* (plan), the yarn-building region includes two drums side-by-side. The cylindrical surfaces CS1, CS2 may be perforated and subject to air suction in known manner. One or both of the drums may revolve. The fibres are opened as described above with the fibre entry FE and the opening device arranged over one of the cylindrical surfaces (CS1) so that fibres, straightened as described above, are laid along the drum in the yarn-building region for incorporation leading-end first into yarn twisted either by revolution of the drum or drums or by an external twister.

While the above description relates to specific exemplary fibre lengths and other conditions tests show that spinning is possible for other fibre lengths and conditions if care is taken to adjust any reduction of pressure, fibre entry size and position relative to the opening wheel and spacing of the groove from the opening wheel to the particular conditions required.

The techniques described above provide an apparatus and method of fibre control for spinning resulting in high speed production of quality yarn in a simple compact device.

We claim:

1. A method of spinning fibers into yarn comprising the steps of:

providing a supply of fibers, providing a yarn-building region including a defined entry, opening fibers from the supply through an exit into the yarn building region, defining a path through said entry of the region for open fibers, restricting said path through said entry by a projection disposed generally transversely with respect to said exit, bending opened fibers around the projection, landing opened fibers in said region, removing energy from landing fibers by straightening said fibers, building and twisting the fibers landed in the region into a yarn, and withdrawing the yarn from the region.

2. A method according to claim 1 including landing opened fibres leading-end first in said region.

3. A method according to claim 1 including causing the fibre trailing-end to flick to remove energy from the landing fibre.

4. A method according to claim 3 including causing the fibre trailing-end to flick to straighten the landing fibre.

5. A method according to claim 1 including reducing the pressure in the yarn-building region to assist fibres along said path.

6. A method according to claim 5 including assisting fibres opened from the supply into the region in the direction of yarn withdrawal.

7. A method according to claim 1 including causing the pressure in the yarn-building region to be non-uniform, assisting the fibre leading-end along said definite path to approach the yarn-end.

8. A method according to claim 1 including causing the opened fibres to adopt the direction of yarn-withdrawal.

9. A yarn spinning apparatus comprising:

means for opening fibers from a supply of fibers, a defined yarn-building region having an entry to receive fibers opened from the supply for twisting into yarn withdrawn from the region, and means for transferring fibers from the opening means to the yarn-building region, the transferring means including a fibre motion-energy control arrangement of first and second fibre transfer apertures of an exit from the opening means and the yarn-building region entry respectively, with the second aperture spaced from the first aperture and having an aperture side extending partially across the first aperture and disposed generally transverse with respect thereto, through which apertures leading ends of fibers bend around the extension formed by said aperture side, land and thereafter straighten, thereby extracting energy from trailing ends of the fibers.

10. A yarn spinning apparatus according to claim 9 in which said transfer means forms a definite path for fibres between said opening means and said yarn-building region.

11. A yarn spinning apparatus according to claim 9 in which said second aperture forms a weir for fibres in transfer between said opening means and said yarn-building region.

12. Apparatus as claimed in claim 11 in which the yarn-building region is of elongate, at least partially closed form and includes a fibre landing groove and said second aperture over the groove as a fibre entry, means for reducing the pressure in said groove and means for withdrawing built yarn from the groove.

13. Apparatus as claimed in claim 12 In which the groove has perforations for the withdrawal of air by the pressure reduction means.

14. Apparatus as claimed in claim 13 in which at least some of said perforations are elongate.

15. A yarn spinning apparatus comprising:

means for opening fibers from a supply of fibers, a defined yarn-building region having an entry to receive fibers opened from an exit of the supply for twisting into yarn withdrawn from the region, a fibre path defining an obstruction in said entry generally transverse with respect to said supply exit to control the motion of fibers therebetween, means for landing fibers from said opening means leading-end first in said region, said motion control being effective in operation to cause fibers landing in the region to follow said path bending around said obstruction and to thereby flick the fibre trailing-end so as to straighten the fibre.

16. Apparatus as claimed in claim 15 in which said motion control causes the landing fibre to straighten out to its full length.

17. Apparatus as claimed in claim 15 including in the yarn-building region a fibre landing groove and a fibre entry over the groove, means for reducing the pressure in said groove and means for withdrawing built yarn from the groove, the arrangement being such that a fibre leading-end entering the region for landing is caused to flick the trailing-end on passing through the entry.

18. Apparatus according to claim 17 in which the opening means is an opening wheel and the yarn landing groove is spaced from the wheel and generally parallel to a tangent to the wheel at the fibre exit.

19. Apparatus as claimed in claim 15 wherein said obstruction overlaps said supply exit to cause fibre trailing-end to flick.

20. Apparatus as claimed in claim 15 including means to exert a non-uniform pressure in the region, controlling the motion of the fibres to encourage the fibre leading-end to approach the yarn-end.

21. Apparatus as claimed in claim 20 in which the arrangement of the fibre entry causes non-uniform pressure.

22. Apparatus according to claim 15 in which the yarn-building region includes means to form a groove of cylindrical surfaces of two side-by-side drums and means to bring fibres to the region by the rotation of a drum, whereby the fibres are landed in said region along the cylindrical surface of said drum.

* * * * *

UNITED STATES PATENT AND TRADEMARK OFFICE

CERTIFICATE OF CORRECTION

PATENT NO. : 5,497,609

DATED : March 12, 1996

INVENTOR(S) : LAWRENCE

It is certified that error appears in the above-indentified patent and that said Letters Patent is hereby corrected as shown below:

On the title page, item [63] should read —Continuation of Ser. No. 220,578, Mar. 31, 1994, abandoned, which is a continuation of Ser. No. 101,106, Aug, 3, 1993, abandoned, which is a continuation of Ser. No. 914,018, Jul. 15, 1992, abandoned, which is a continuation of Ser. No. 689,789, May 20, 1991, abandoned, which was the national stage of International application number PCT/GB89/01405, filed Nov. 23, 1989.

Signed and Sealed this

Twenty-seventh Day of August, 1996

*Attest:*

Bruce Lehman

BRUCE LEHMAN

*Attesting Officer*

*Commissioner of Patents and Trademarks*